United States Patent [19]

Collins et al.

[11] Patent Number: 5,044,004

[45] **Date of Patent: * Aug. 27, 1991**

[54] FLASH X-RAY APPARATUS

[75] Inventors: C. B. Collins, Richardson; F. Davanloo; J. J. Coogan, both of Dallas, all of Tex.; T. S. Bowen, Aberdeen, Md.; R. K. Krause, Dallas, Tex.

[73] Assignee: Board of Regents, The University of Texas System, Austin, Tex.

[ * ] Notice: The portion of the term of this patent subsequent to Aug. 7, 2007 has been disclaimed.

[21] Appl. No.: 155,218

[22] Filed: Feb. 12, 1988

Related U.S. Application Data

[63] Continuation-in-part of Ser. No. 861,491, May 9, 1986.

[51] Int. Cl.[5] ..... H05G 1/10

[52] U.S. Cl. ..... 378/101; 378/106; 378/122

[58] Field of Search ..... 378/101-102, 378/105-107, 121-123, 140; 313/361.1, 363.1; 328/67, 233, 235

[56] References Cited

U.S. PATENT DOCUMENTS

| | | | |
|---|---|---|---|
| 2,341,483 | 2/1944 | Stephen | 378/123 |
| 2,900,542 | 8/1959 | McEuen | 378/156 |
| 3,432,664 | 3/1969 | Robison | 378/106 |
| 3,783,288 | 1/1974 | Barbour et al. | 378/122 |
| 4,429,228 | 1/1984 | Anderson | 250/374 |
| 4,517,497 | 5/1985 | Malone | 328/67 |
| 4,563,584 | 1/1986 | Hoffman et al. | 250/366 |
| 4,570,106 | 2/1986 | Sohval et al. | 313/363.1 |
| 4,947,415 | 8/1990 | Collins | 378/140 |

FOREIGN PATENT DOCUMENTS

| | | | |
|---|---|---|---|
| 0819850 | 4/1981 | U.S.S.R. | 378/122 |
| 0589127 | 6/1947 | United Kingdom . | |

OTHER PUBLICATIONS

"Scaling, to High Average Powers of a Flash X-Ray Source . . . ", by Davanloo et al., Rev. Sci. Instr., vol. 58, #11, Nov. 1987, pp. 2103-2109.

Flash X-Ray Tube for Diffraction Studies . . . Johnson et al., Rev. Sci. Instrum 51(6), Jun. 1980, p. 741.

A High Intensity, Fine Focus, Source of Continuous . . . by Ottewell et al., J. Phys E. (G.B.), vol. 4, No. 10 (Oct. 1977).

A High Energy Flash X-Ray Facility-by Gilbert et al., British Journal of NDT, May 1974.

Cook et al., "Off-Resonance Transformer Charging for 250 kV Water Blumlein", 10/79, vol. ED-26, No. 10, IEEE Trans. on Electronic Devices, pp. 1512-1517.

Swift et al., "Flash X-Ray Actuated Trigger Switch", 5/68, vol. 30, No. 5, The Review of Scientific Instruments, pp. 728-730.

*Primary Examiner*—Craig E. Church

*Attorney, Agent, or Firm*—Arnold, White & Durkee

[57] ABSTRACT

An apparatus for producing high energy, pulsed, flash X-rays which is of a useful laboratory-scale size. The apparatus includes a hydrogen thyratron coupled between a D.C. power source and a low impedance Blumlein, and a low impedance X-ray head. The thyratron is in a grounded grid configuration and provides a commutated input voltage to the Blumlein at a high repetition rate. The switching waveform output of the Blumlein is applied across a pair of spaced electrodes in the X-ray head to produce an X-ray emitting discharge therebetween. A portion of the electrode assembly is preferably cast integral in an insulating base plate of the head. A pair of foil sheet conductors are preferably cast in the base plate to respectively connect the electrodes to the Blumlein. An apertured cover plate is mounted over the base plate with a seal ring interposed between the plates around the electrodes to establish a sealable evacuatable chamber around the discharge gap between the electrodes. In the high voltage embodiment, eight Blumleins are stacked to be charged in parallel and synchronously commuted by a single thyratron at one end stacked in series at the other end. Significant voltage gain is maintained for periods around 20 ns to produce discharge voltages to 200 kV in an x-ray diode at peak currents of 0.5 kA for a 60 kV charging voltage.

14 Claims, 7 Drawing Sheets

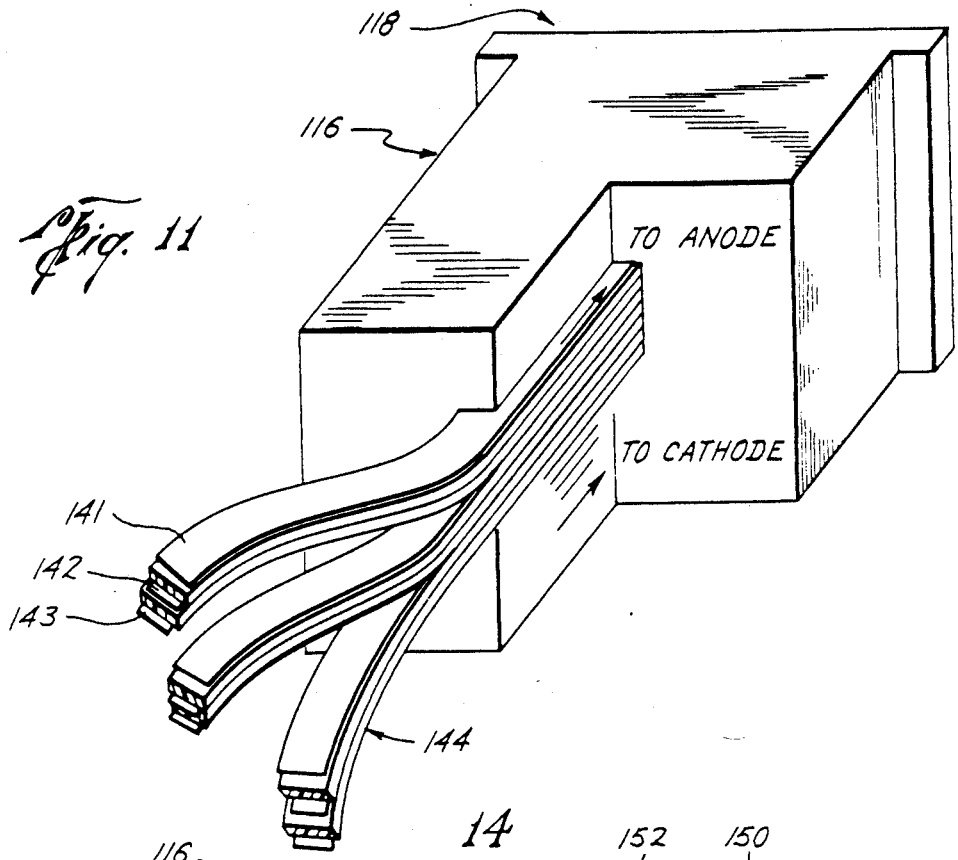
Fig. 11
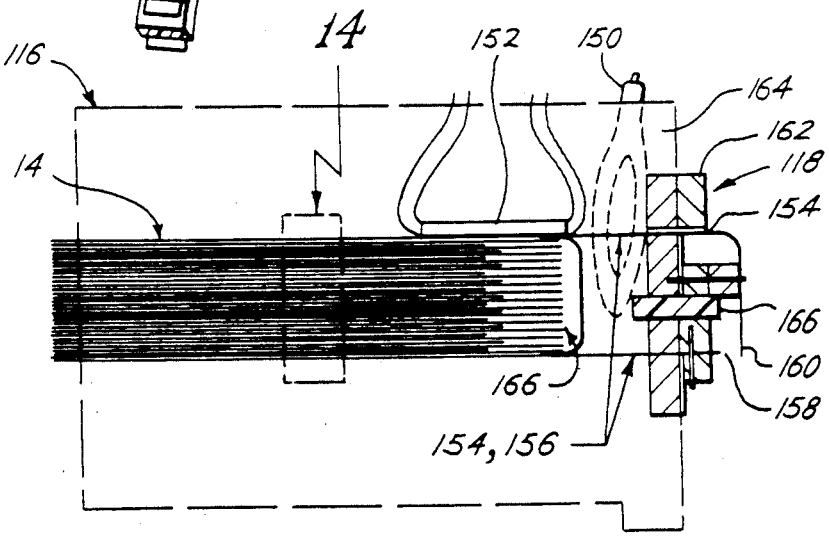
Fig. 12
Fig. 13
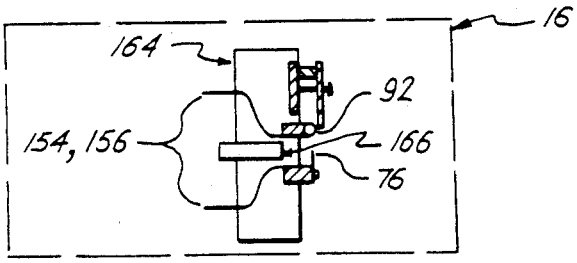
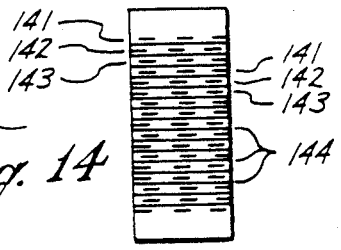
Fig. 14

FLASH X-RAY APPARATUS

This is a continuation-in-part of application Ser. No. 861,491 filed May 9, 1986.

BACKGROUND OF THE INVENTION

The Government may own certain rights to this invention under Office of Naval Research Grant No. N0014-81-K653 and N0014-81-K-0478, entitled "Demonstration of Feasibility of Tuning and Stimulation of Nuclear Radiation."

1. Field of the Invention

The present invention relates to an apparatus and method for producing high energy, repetitively pulsed, flash X-rays from a filamentary source. Advantageously, the apparatus is of a laboratory scale size and incorporates a low impedance Blumlein assembly coupled to a low impedance X-ray head.

2. Description of Related Art

Sources of X-ray energies are known, such as the low energy X-ray devices used in the medical arts. However, the present invention relates to a high energy, short pulse, X-ray producing apparatus which is useful in many applications, particularly fundamental physics research where it is desired to produce a high energy light source in the X-ray bandwidth. In the past, such high energy X-rays have been produced by either a laser plasma or synchrotron radiation device. Synchrotrons and laser plasma devices have several advantages, such as rich line spectra and collimated beams; however, they are not only quite expensive to obtain and operate, but additionally are massive devices which are unsuitable in many applications where a compact source of high energy X-rays are desired. In particular, where the distinct advantages of a synchrotron or laser plasma device are not necessary, a compact, laboratory-scale size device which would produce repetitively pulsed, high energy X-rays would be desirable.

Several devices have been proposed for producing such high energy X-rays from a compact, X-ray device. In one instance, a portable X-ray generator has been proposed which is capable of producing repetitively pulsed X-rays having a pulse duration as short as 100 nsec. However, it has been proposed that such a portable generator is limited by fundamental theoretical considerations in producing an X-ray pulse much shorter than 100 nsec.

It is a goal in quantum electronics to develop a compact high energy light source. Theoretically, such a light source within the band widths of general interest would have pulse durations of a few nanoseconds. Therefore, it would be a significant advance in the art if a compact, repetitively pulsed, flash X-ray device were developed which could operate at a pulse duration as short as a few nanoseconds to produce high energy X-ray photons.

SUMMARY OF THE INVENTION

The present invention presents solutions to the search for a compact, high energy light source by providing a flash X-ray apparatus which operates at a short pulse duration to produce a relatively high average power. The flash X-ray apparatus of the low voltage embodiment of the present invention has operated at an average pulse duration less than 6 nsec. at energies near 8.0 keV to produce an average power of 35 mW. The low voltage embodiment of the flash X-ray apparatus can produce in less than 1 minute an integrated X-ray fluence comparable to that obtained from much larger synchrotrons and laser plasma devices. In applications where the average power delivered and the size of the X-ray source are prime considerations, the compact, flash X-ray apparatus of the present invention offers an attractive alternative to either syncrotron or laser plasma X-ray devices.

Broadly speaking, the apparatus of the present invention includes a commutation means coupled to a power source, a Blumlein section (one or more Blumleins) operably connected to the commutation means and an X-ray head. The commutation means is coupled to the power source for commuting the current at a high repetition rate and preferably, comprises a hydrogen thyratron in a grounded grid configuration. The Blumlein section provides a low impedance switching waveform from the commutation means to the X-ray head. The X-ray head includes a sealable chamber having an X-ray emitting aperture, a pair of spaced apart electrodes mounted in the chamber, and a pair of low impedance connectors which couple the electrodes to the Blumlein section. Operationally, application of the commutated current through the low impedance Blumlein section and connectors effects a pulsed, flash discharge between the electrodes, causing an X-ray emision through the aperture. The coupling of the Blumlein means, connectors, and electrodes provides a generally matched, low impedance path. A pair of low impedance spaced-part electrodes are mounted in the X-ray head. Also a pair of low impedance connectors are coupled to the electrodes and to the series connected Blumlein means and connectors. In the context of the present invention, "low impedance" means less than about 100 ohms.

Preferably, the X-ray head includes a base of insulating material, an electrode assembly mounted on the base, a pair of foil sheet conductors passed through the base and connected to the electrode assembly, and a sealable chamber surrounding the electrode assembly. The electrode assembly comprises an anode and cathode, each having an elongated discharge surface, with the discharge surfaces being spaced apart equidistant to define a discharge gap therebetween. The foil conductors are preferably cast integral in the insulating base to provide a low inductance, short path connection between the electrodes and the Blumlein section without the possibility of arcing between connectors.

The present invention additionally contemplates a method of generating a flash X-ray fluence at a high repetition rate. In the context of the present invention, "high repetition rate" means greater than one per second. Broadly speaking, the method includes supplying a direct current to a thyratron which is operably connected to a low impedance Blumlein section. A middle conductor of each Blumlein is charged and the current then commuted over each Blumlein and the charge/-commuted cycle recurring at a high repetition rate. The high repetition rate power output is transmitted over the Blumlein section to a pair of spaced apart electrodes disposed in an evacuated shell. The pulsed current generates a filamentary source of X-ray radiation in the space between the two electrodes to produce a high energy X-ray emission.

The high voltage embodiment of the present invention the Blumlein section preferably includes eight Blumleins stacked in series at one end, and connected at the other end to a single thyratron synchronously commuted. Thus, the Blumleins are successively stacked for charging in parallel to add voltage pulses for tens of nanoseconds in a configuration which can be switched by the single thyratron without impedance transformation. In the high voltage embodiment, the eight Blumleins are placed adjoining and insulated from each other to prevent interline flashover. The Blumleins are switched from the side by side parallel configuration to the series configuration at the head by using copper foils which curve inwardly so that the foil lies on top of each other.

BRIEF DESCRIPTION OF THE DRAWINGS

FIGS. 1–7 depict the low voltage embodiment in which:

FIG. 1 is a perspective view of the flash X-ray producing apparatus of the present invention;

FIG. 2 is a sectional view taken along line 2—2 of FIG. 1 of the apparatus;

FIG. 3 is a sectional view taken along line 3—3 of FIG. 2 and particularly illustrates the electrode assembly of the X-ray head of the present invention;

FIG. 4 is a sectional view taken along line 4—4 and illustrates another view of the X-ray head and its connection to the Blumlein;

FIG. 5 is a fragmentary, exploded view of the apparatus of the present invention;

FIG. 6 is a graph which plots the output energies as a function of electrode spacing; and FIG. 7 is a graph which plots average output energies as a function of repetition rate.

FIGS. 8–18 describe the configuration and performance of the high voltage embodiment of the present invention in which:

FIG. 8 is a schematic, partially exploded view of the flash x-ray apparatus;

FIG. 9 is a schematic view in partial section showing the connection of the thyratron to the multiple Blumleins;

FIG. 10 is a vertical sectional view showing the connection of a Blumlein to the commutation assembly at one end and the pulse stacking module at the other end;

FIG. 11 is a schematic view of the pulse stacking module showing three of the eight Blumleins stacked in series;

FIG. 12 is a schematic, vertical sectional view of the pulse stacking module showing the connection of the Blumlein section to the head;

FIG. 13 is a schematic, vertical sectional view of the x-ray head of FIG. 4 shown connected to the Blumlein section of FIG. 12;

FIG. 14 is an enlarged, sectional along line 4—4 and illustrates another view showing the detail from FIG. 12;

FIG. 15 is a graph showing voltages across individual Blumleins and across the series stack with and without load as a function of time;

FIG. 16 is a graph depicting the relationship between load voltage, load current, and x-ray output emitted from the tungsten anode;

FIG. 17 is a graph showing a typical spectral distribution of flux emitted from the tungsten anode at a charging voltage of 50 kV; and FIG. 18 is a graph plotting average dose outputs emitted as x-rays near 1Å as a function of the pulse repetition rates for a charge voltage of 50 kV.

DESCRIPTION OF THE PREFERRED EMBODIMENTS

1. Embodiment of FIGS. 1–7

Figure 1:
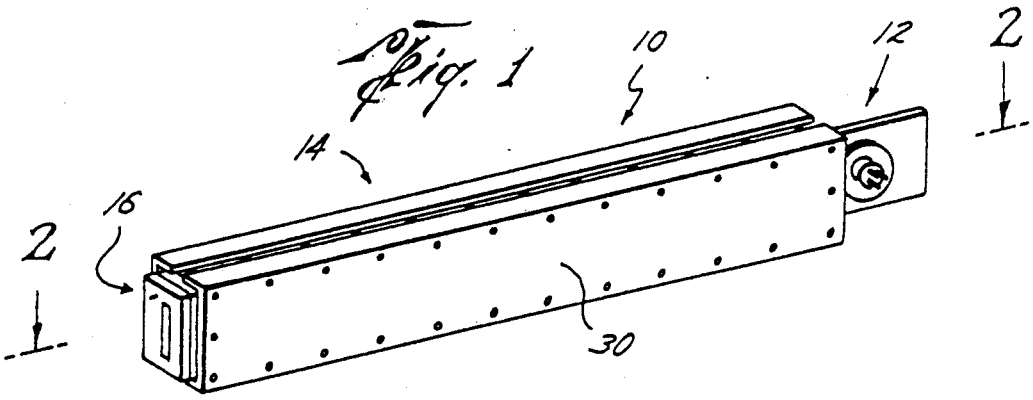

Turning now to the drawings, FIGS. 1–7 illustrate an apparatus 10 in accordance with the present invention which produces an intense, filamentary source of flash X-rays at a high repetition rate. Broadly speaking, the apparatus 10 includes commutation means 12, Blumlein assembly 14, and an X-ray head 16 (see FIG. 2). Preferably, the commutation means comprises a thyratron can 20 and a thyratron 22 which is capable of operation at a high repetition rate, i.e. greater than 50 Hz. The thyratron 22 is coupled to a power source (not shown), preferably a DC power source.

Figure 3:
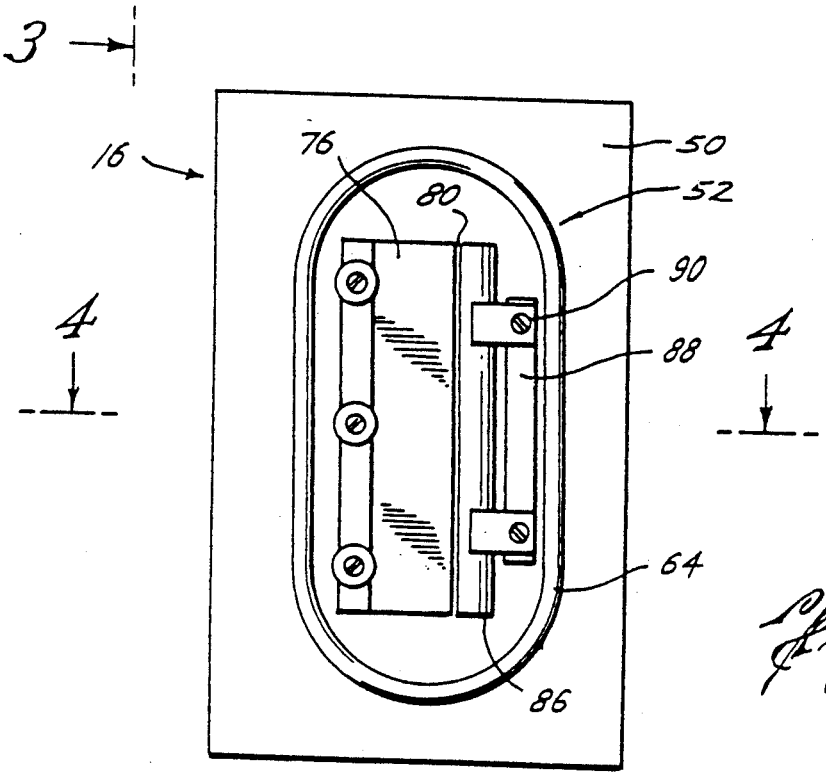
Figure 4:
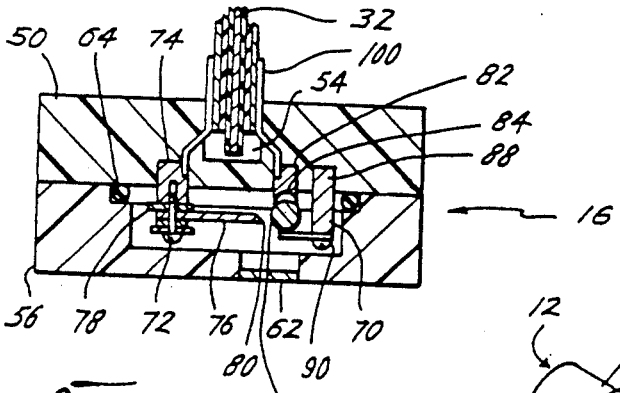
Figure 5:
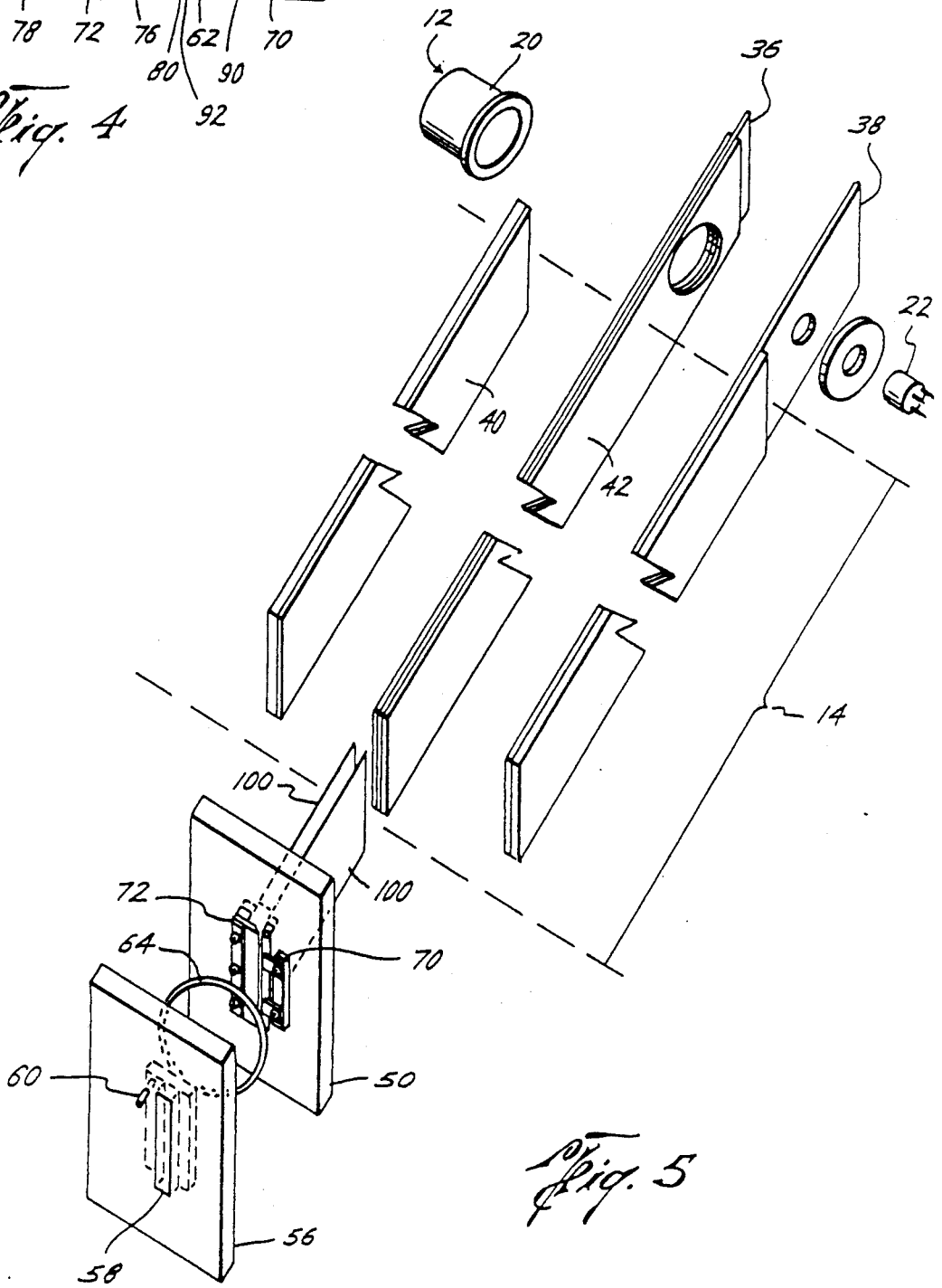

The embodiment of FIGS. 1–7 illustrate a single Blumlein (i.e. low voltage) configuration. The Blumlein assembly 14 includes an outer casing 30 holding the elongated single Blumlein device 32 and insulating material 34. As shown in FIG. 5, the Blumlein device 32 broadly includes a middle conductor 36 and a pair of outer conductors presenting switched side 38 and storage side 40. The middle conductor 36 is sandwiched between dielectric sheaths 42 (preferably a polyimide such as Kapton), while the outer conductors 38, 40 are cast in an insulating epoxy material as at 44. In FIG. 5, the thyratron 22 is illustrated somewhat schematically and is coupled to the middle conductor 36 and switched conductor 38 in a grounded grid configuration.

Figure 2:
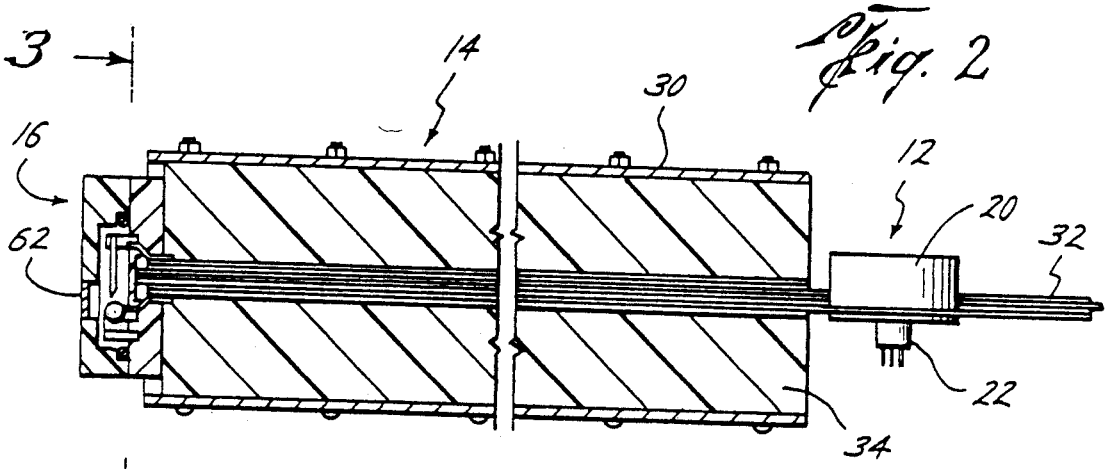

The X-ray head 16 broadly includes a base plate 50 comprising an insulating material and an electrode assembly 52 mounted on the base 50 as shown in FIG. 3. The base plate 50 is cast to include a Blumlein receiving channel 54 as shown in FIGS. 2 and 4. A cover plate 56 of insulating material is designed to overly base plate 50 (see FIG. 5) and includes an X-ray emitting aperture 58 and evacuation port 60 as shown best in FIGS. 2 and 4. The X-ray emitting aperture 58 includes a polyimide (Kapton) film 62 which operates to permit the emission of X-rays while providing an effective gas seal. An O-ring 64 is interposed between the base and cover plates 50, 56 around the electrode assembly 52 to cooperatively define a sealed chamber surrounding the electrode assembly 52. It will thus be appreciated that with a mechanical pump (not shown) connected to the evacuation port 60, the O-ring 64 and film 62 allows the region surrounding the electrode assembly 52 to be partially evacuated (to approximately 3.0 mTorr). The evacuation tends to hold the plate 56 in position relative to the plate 50 but a clamp (not shown) is typically used for added assurance.

In more detail, the electrode assembly includes anode side 70 and a cathode side 72. The cathode side 72 includes a mounting bracket 74 cast integral into the base 50 for supporting the elongated cathode plate 76 (FIG. 4). The cathode plate 76 is coupled to the bracket 74 with one or more screws and shims 78 so that the position of the cathode plate 76 can be adjusted relative to the bracket 74. Preferably, the cathode plate is comprised of graphite and includes a beveled edge at its distal end to define an elongated, thin, discharge surface 80.

The anode side 70 includes a mounting bracket 82 which includes an elongated arcuate channel 84 (FIG. 4) which is cast integral in the base 50. An anode cylinder 86 is received in the channel 84 and positioned in general alignment with the cathode plate 76 as shown in FIGS. 2-4. A retention bracket 88 is cast into the base plate 50 parallel to the mounting bracket 82 and includes a pair of retention clips 90 for retaining the anode cylinder 86 in the mounting bracket 82. Advantageously, the anode cylinder 86 can be rotated in the channel 84 to account for surface wear. Further, the anode cylinder 86 is easily replaceable to change from the copper cylinder of the test embodiment to another cylinder such as tungsten, molybdenum, silicon or platinum.

As can be appreciated from FIGS. 2-4, the anode cylinder 86 comprises an outermost discharge surface 92 which makes contact along the two upper ends of the channel 84 as shown in FIG. 4. The anode cylinder 86 is optimally mounted in general alignment with the cathode plate 7 with the cathode discharge surface 80 oriented generally at the center of the anode cylinder 86. A discharge gap is defined between the cathode discharge surface 80 and anode surface discharge surface 92.

The electrode assembly 52 is coupled to the Blumlein assembly 14 by a pair of copper, foil sheet conductors 100. The foil sheets 100 are cast integral in the base 50 to prevent any air leakage through the base 50 and also to prevent any inadvertent discharge between the foil sheet conductors 100 while providing a low impedance discharge path. As shown in FIG. 4, the foil sheets 100 emerge from the base plate 50 in the region of the channel 54 to connect to the respective outer conductors 38, 40 of the Blumlein device 32. Advantageously, the foil sheets 100 are very thin such that there is practically no coefficient of expansion difficulties between the material of the base 50 and copper foils 100. That is, the thin foils 100 tend to compress somewhat upon differential thermal expansion during operation of apparatus 10.

In its design, the apparatus 10 of the present invention was configured to give a low impedance power transmission through the Blumlein assembly 14 to a low impedance X-ray head 16. The Blumlein conductors 36, 38, 40 were constructed from massive cooper plates and potted with the epoxy casting 44 to reduce corona and separated by the polyimide (Kapton) dielectric sheaths 42. Of course, other dielectrics such as water might conceivably be used. The emphasis of the design was to obtain a singularly low inductance input to the electrode assembly 52 to give a filamentary source of X-ray radiation from the X-ray head 16.

The design of the X-ray head 16 is from cast materials to minimize corrosion, maximize heat transfer, and to prevent inadvertent air leaks around the electrode assembly 52. The design of the foil sheets 100 prevents any transverse constriction of the current path between the Blumlein device 32 and the electrode assembly 52. Further, the effective electrical length of the foil sheets 100 is selected to give a resistance that was comparable to, but below the line impedance of the Blumlein device 32, in order to assist in dampening any secondary ringing of the discharge current between the anode and cathode surfaces 80, 92.

The commutation means 12 comprises an E.G&G 3202 hydrogen thyratron mounted in a grounded grid configuration. A low voltage power source is connected to heat the thyratron 22, and a high voltage direct current power source was connected to the thyratron 22 with an average available input power to support an operation of the thyratron 22 at a 100 Hertz repetition rate. It will be appreciated that a pulse charge power supply or a resonant pulsed charging device may also be used as a substitute power supply. The thyratron 22 is connected to the middle conductor 36 of the Blumlein device 32 to precharge the Blumlein to a positively high voltage and then fired to commutate the input power.

In this embodiment, the anode cylinder 86 was formed of a copper material for experimental safety. Depending on the application, other suitable conducting metals are desirable substitutes, such as tungsten, depleted uranium, silicon, molybdenum, platinum, rhodium, rhenium or other metal discharge surfaces having the desired spectral characteristics.

With the middle conductor 36 of the Blumlein precharged, the Blumlein 32 is commutated to provide a low inductance pulse through the foil sheets 100 to the electrode assembly 52. The charge voltage of the Blumlein in turn effect a discharge across the gap between the anode and cathode discharge surfaces 80, 92 to produce a filamentary source of X-ray radiation of repetitively pulsed X-ray radiation between the electrodes. As explained in the following illustrative example, the pulsed discharge X-ray effluent has been found to produce a high average power and a short temporal pulse duration with the X-ray pulse energies increasing at higher repetition rates. This increase in X-ray pulse energies at higher repetition rates is in contrast with known applications of Blumleins in gaseous laser media.

EXAMPLE

An apparatus in accordance with the low voltage embodiment of the present invention has been constructed and included an EG&G 3202 hydrogen thyratron 22 mounted in a grounded grid configuration to a Blumlein 32. The thyratron 22 was connected to a DC input power source, precharged the middle conductor 36 to 25 KV, and operated at 100 Hertz repetition rate. The approximate line impedance of the Blumlein was calculated about 1.5 ohms with a transit time of approximately 5.3 nsec. The capacitance of the switched side was calculated at 3.5 nF while the storage side 40 was measured at approximately 3.2 nF. While a DC power supply was used in this example, a resonant discharge pulse power input may be used as well.

The cathode graphite plate 76 was 0.381 mm thick with the plate approximately 10 cm in length. In the preferred embodiment, the cathode discharge surface 80 was an elongated rectilinear surface parallel and equidistant from the anode discharge surface 92 of the anode cylinder 86. The distance separating the discharge surfaces 80, 92 was varied to optimize performance.

A mechanical pump was used to evacuate the region surrounding the electrode assembly 52 through the evacuation port 60. In addition to the 0.076 mm thick Kapton plastic film 62, the experimental device included a 0.127 mm thick graphite plate overlying the aperture 58 to prevent the emission of visible and UV light. The mechanical pump was effective and operated to partially evacuate the region at pressures surrounding the electrode assembly 52 below 3.0 mTorr. The evacuation of the region surrounding the electrode assembly 52 held the plates 50, 56 together with a clamp (not shown) added to ensure the arrangement.

Outputs were detected from the X-ray head 16 with a block of fast scintillator plastic detector with a nominal 7.0 nsec. decay time. Measurements of absolute intensities were made by comparing the fluorescence from the plastic detector when illuminated with geometrically attenuated X-rays from the apparatus 10, with the level of excitation produced by a radioactive source of known characteristics. The results obtained suggest that there is a weak dependence of the X-ray effluent output on the spacing between the anode and cathode discharge surfaces 80, 92 over a wide range. Further, the pulse duration was found to have a temporal width of approximately 6 nsec. which can be varied by changing the separation distances between the cathode and anode discharge surfaces 80, 92.

Figure 7:
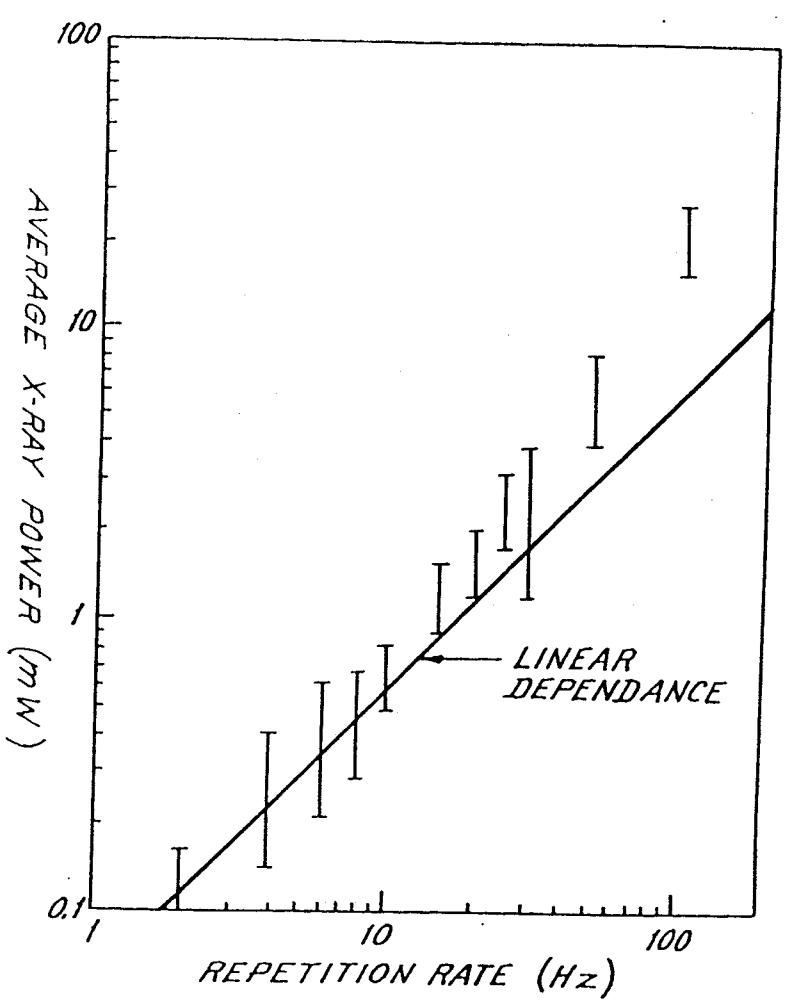
Figure 6:
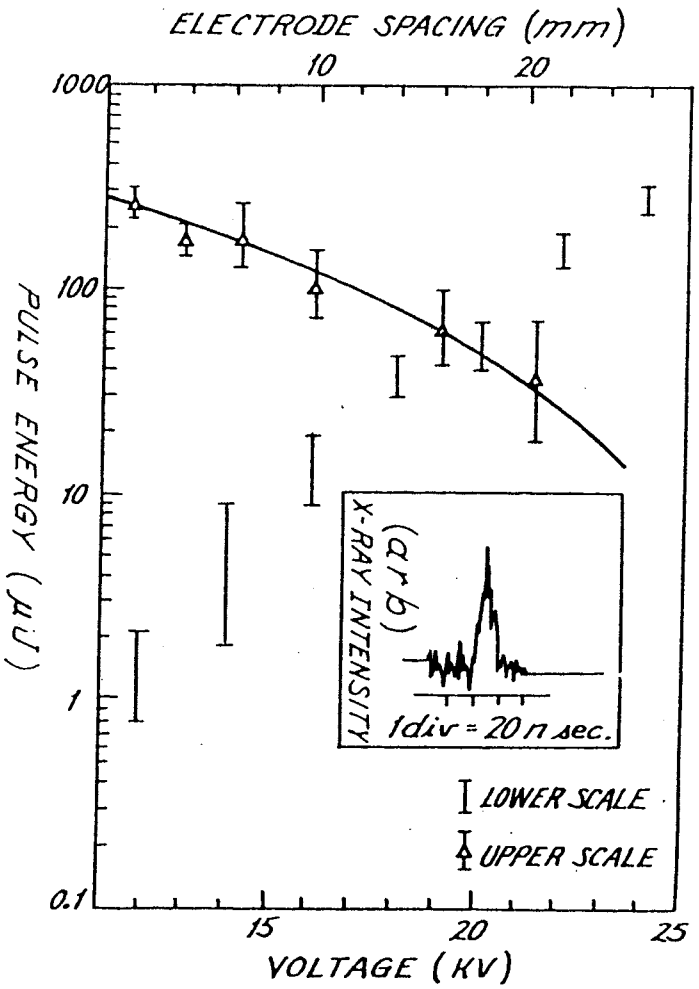

Advantageously, at higher repetition rates, the X-ray pulse energies were found to increase markedly. In fact, the average X-ray power emitted as a function of repetition rate was greater than linear, because of the enhancement of the pulse energies at higher values. The apparatus 10 produced 35 mW of average power isotropically from the 6 nsec. pulses at energies near 8 keV. FIGS. 6 and 7 illustrate the experimental results.

2. Embodiment of FIGS. 8–18

One constraint on the operation of the apparatus 10 in accordance with the embodiments of FIGS. 1–7 is the limitations on peak currents and voltage tolerances of existing commercial thyratrons such as thyratron 20. Presently obtainable thyratrons 20 have operating parameters with constrain operation of apparatus 10 to approximately 20 kA and 150 kV for peak currents and voltage tolerances respectively. The embodiment of FIGS. 8–18 illustrates a flash x-ray apparatus 110 which is capable of obtaining voltages far exceeding 100 kV, while retaining the capabilities for operating at high repetition rates.

Broadly speaking, the apparatus 110 includes a commutation mechanism 112 for commuting a Blumlein assembly 114. The Blumlein assembly 114 is connected in series at the pulse stacking assembly 116 for series connection to the x-ray head 118. The nominal length of the apparatus 110 is four meters and in use the apparatus 110 is immersed in a closely fitting pan filled with transformer oil (not shown). The x-ray head 118 is preferably sealed with a gasket into the wall of the pan so that the output from the head 118 can immerge without passage through the transformer oil.

Figure 9:
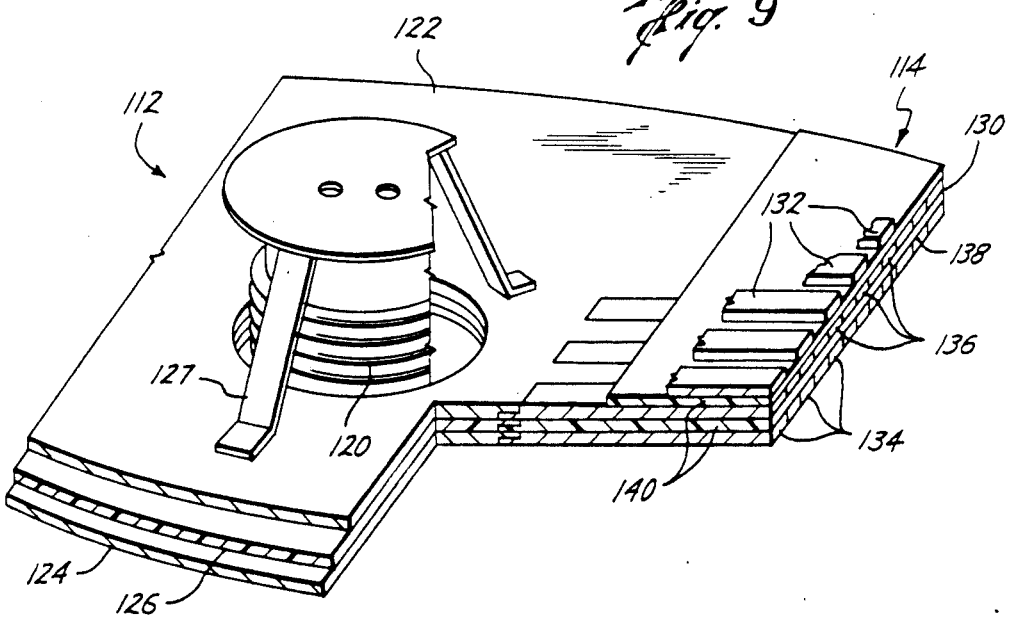

The commutation mechanism 112 is shown in more detail in FIG. 9. A thyratron 120 (such as shown in FIG. 2) provides the impulsive connection to two massive copper plates 122, 124 constructed from 3.2 mm stock with rounded edges. The copper plates 122, 124 are separated by an insulator, such as the layered Kapton dielectric 126 shown in FIG. 9. The plates 122, 124 and Kapton layer 126 are pierced to permit insertion of the thyratron 120. The edges of the plate 124 are insulated by finger-like extensions of the Kapton layer 126 (not shown). Connection of the lower plate 124 to the anode well of the thyratron 120 is accomplished with a low inductance commercially available can. Current returns 127 are provided for connection to the top plate 122.

The Blumlein assembly 114 comprises a plurality of Blumleins 130 which operate in a fashion similar to the Blumlein 32 of the embodiment of FIG. 1. The embodiment of FIGS. 8–18 shows eight individual Blumleins 130, each having a storage plate 132 (top plate), a switching plate 134 (bottom plate) disposed on each side of a high voltage center plate 136. The storage and switching plates 132, 134 are copper plates 3.8 cm in width, 3.2 mm thick and 3.1 m long with rounded edges. The center plate 136 is similar, but is only 2.5 cm wide to reduce field stresses at the edges and to increase a dielectric life time. The switching plates 134 are connected to the lower plate 124, while the center plates 136 are connected to the high voltage plate 122. The storage and switching plates are each connected to D.C. ground through connections (not shown).

Thirteen laminated Kapton (polyimide) dielectric layers 138 (0.127 mm thick) separate the individual plates of the Blumlein 130. Laminated Kapton sheets 140 separate the storage and switching plates 132, 134 from the center plate 136. The Kapton layers are manufactured using a lamination process in which alternating layers of Kapton and high dialectric epoxy are pulled through a heavy steel roller press. The Kapton sheets 140 have an average thickness of 2.3 mm giving a line impedance of 26 ohms.

Figure 10:
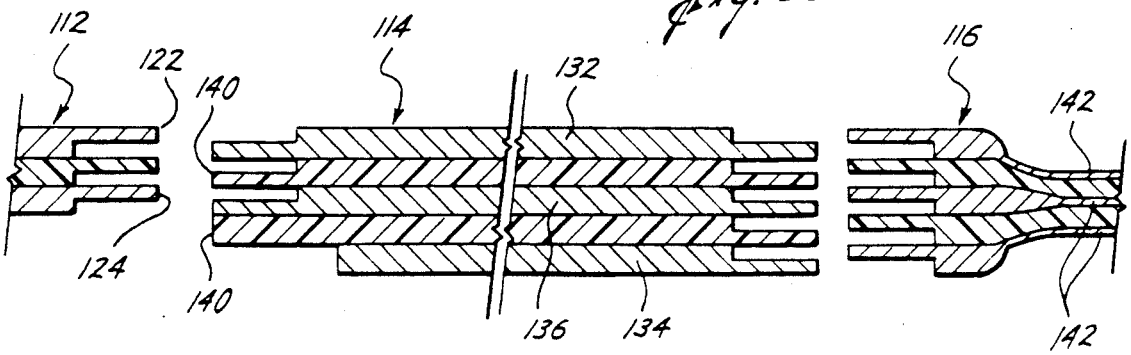

As shown in FIG. 10, the Blumlein assembly 114 configures the plates 132, 134, 136 and Kapton layers 138, 140 so that it might be "plugged-in" by a lapped joint to the pulse stacking assembly 116 and commutation mechanism 112 (thyratron end). The plates are preferably completely sheathed in a dialectric. In addition to the Kapton sheets 140 between the plates 132, 134, 136, a 3.2 mm thick Lexan (polycarbonate) sheets encloses the sides. Advantageously, the Kapton layers 138 between each Blumlein 130 prevent interline flashover.

FIG. 11 illustrates the pulse stacking assembly 116 connecting the Blumlein assembly 114 to the x-ray head 118 in which the Blumleins 130 are switched from parallel to series. The conductive plates 132, 134, 136 are lapped to lengths of copper foil 141, 142, 143 (compare FIG. 10) with the foil 141-143 being cut into curves in the plane of the foil so that the conductors from successive lines can be displaced towards the center where they will lie over each other as shown in FIG. 11. As shown in FIG. 11, the bottom foil 143 of the first conductor (left hand) lies in electrical contact with the top foil 141 of the second conductor. The top foil and bottom foil series contact is made throughout the stack as shown in FIGS. 11 and 14. Dialectric laminated Kapton sheets 144 curve along the same lines to isolate the foils 142 and to try to maintain a reasonably constant transmission line impedance with each Blumlein section being stacked (compare FIG. 11 and 14). The resulting series section at the end of the lines shown in FIG. 11 are cast to minimize corona. It should be understood that FIG. 11 illustrates only three of the eight connections to the Blumleins 130.

Turning to FIG. 12, the pulse stacking assembly 116 and x-ray head 118 are shown in more detail. The pulse stacking assembly 116 includes a current transformer 150 as well as an anode cooling system 152. Top and bottom (e.g. anode and cathode) foil sheets 154, 156 (similar to foil sheet 100 of FIGS. 1–7) lead to the electrodes 158, 160 as shown. The anode and cathode foils 154, 156 are conveyed through a high temperature ceramic 162 which is directly set into the cast material base wall 164.

Within the configuration of FIG. 12, the electrodes 158, 160 are connected to the foils 154, 156 immerging from base wall 164 from the series part of the lines. The cathode 158 comprises a 0.5 cm wide graphite blade of 0.38 mm thickness connected to the foil 156. A tungsten anode 160 is shown interchangably connected to the anode foil 154. The line and continuous x-ray emission intensities are angularly distributed with respect to incident electron direction. The bremsstrahlung becomes more peaked in four directions as the incident electron energy increases. Thus, the most energetic photons of the continuum of x-rays are observed in the direction of the discharge electrons and the useful part of the x-rays emerge from an output window in the direction of the incident electron beams colliding with the anode foil 160. The spacing between the anode 160 and cathode 158 is adjusted by varying a ceramic shim under the anode.

FIG. 13 shows the connection of the x-ray head 16 illustrated in the embodiment of FIGS. 1–7 as an alternative to the x-ray head 118 of FIG. 12. In FIG. 13, like numerals have been applied to the similar components as illustrated in the low voltage embodiment (see, e.g., FIG. 4). As in FIG. 12, it should be noted that a Kapton insulating block 166 is interposed between coils 154, 156. The x-ray head of FIG. 13 is used in a low voltage operation of the apparatus 110 and useful x-rays are observed from an output window perpendicular to the direction of the discharge electron.

Figure 8:
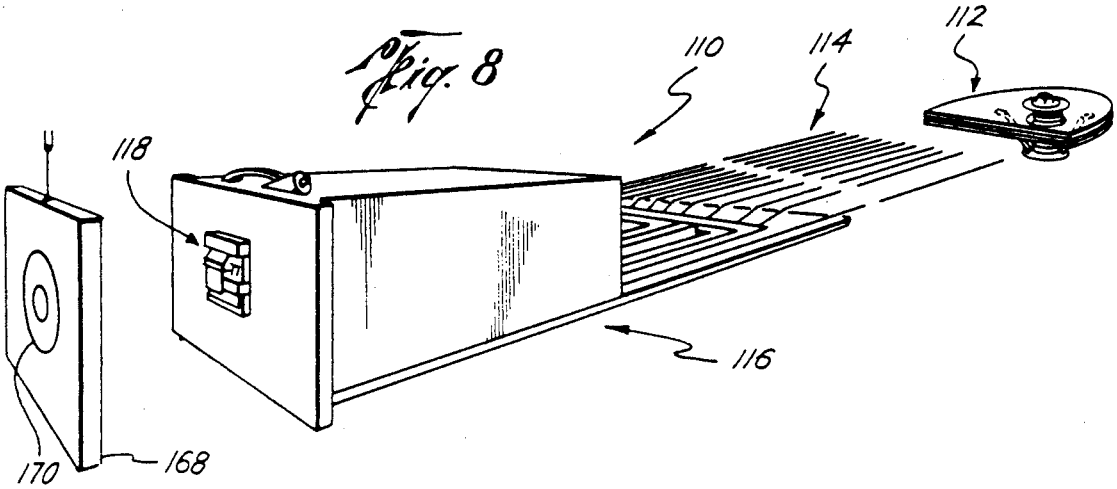

As shown in FIG. 8, a cover 168 is placed over the x-ray head 118 and an O-ring (not shown) is used to produce a seal around the head for obtaining a vacuum. The cover 168 was machined out of Delrin plastic and the region around the electrodes with the cover 168 in place can be evacuated to pressures below 5 microns. An output window 170 made of layered Kapton and graphite is placed directly in front of the electrode discharge area as seen in FIG. 8. In operation, all components except the cover 168 with the output window 170 are immersed in transformer oil.

Example of the High Voltage Embodiment

In operation, the Blumleins 130 were resonantly pulse charged with a source capable of bringing the 16 nF total capacitance of the system to a selected voltage in the range 3–75 kV in 100 μs. The middle conductors 136 were charged to a positive high voltage. For the performances described in this example, commutation was effected by a three-stage EG&G 5353 hydrogen thyratron 120 mounted in a grounded cathode configuration.

Figure 15:
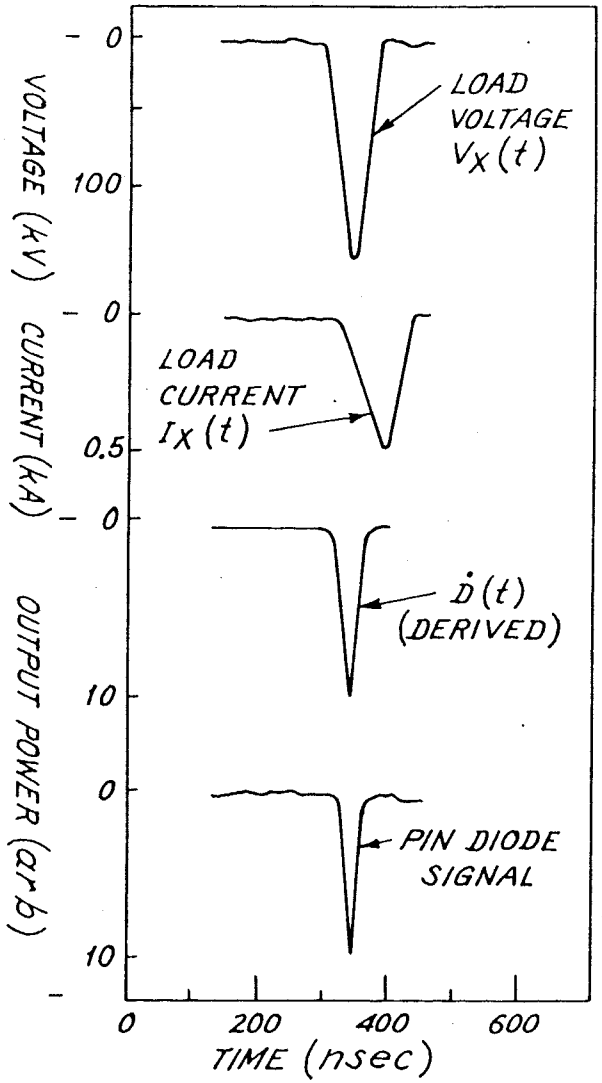

Both the voltages launched on individual lines 122, 124 and the voltage pulse appearing across the series stack at the head 118 were measured with tapped water resistors connected to a Tektronix 7912AD transient digitizer. A comparison of pulses launched and received at the pulse stack assembly 116 for both open and loaded circuits is shown in FIG. 15. As can be seen, the output voltage into a matched load approached four times the charging voltage of each line.

Figure 16:
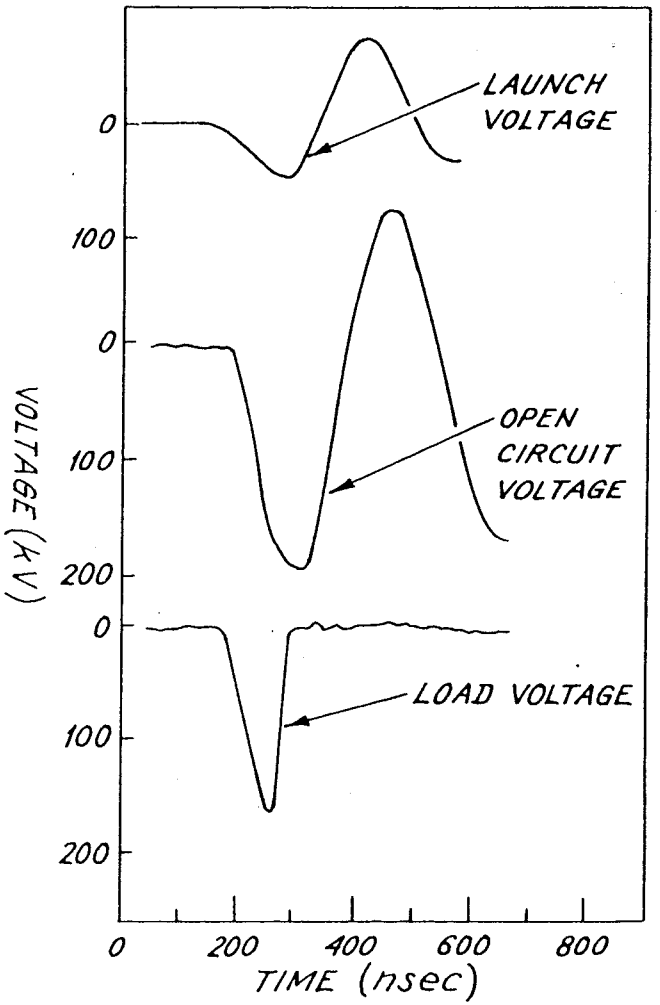

The temporal evolution of the x-ray output from the diode is shown in FIG. 16, together with the time dependence of the voltage and current at the diode. For this measurement, the x-rays were detected with a PIN diode directly coupled to the Tektronix 7912AD. Electrical performance was recorded with the integral diagnostics described above. Synchronization was readily maintained between records of voltages and PIN diode signals, but the current monitor required a different grounding arrangement which disturbed the triggering. The relative phase of the current pulse on the time scale of FIG. 15 had to be determined from the relationship between instantaneous power and the corresponding time derivative of the x-ray rose, D.

$$D(t) - K_c I(t) V^2(t) + K_L I(t)[V(t) - V_k]1.7$$

where I(t) and V(t) denote the instantaneous values of current and voltage, respectively, at the x-ray diode 158 and $V_k$ is the potential of the K edge for the material of the anode 160. The first term of Eq. (1) describes the energy emitted as bremsstrahlung continuum, while the second describes emission of the characteristic lines of the anode. The constants $K_c$ and $K_l$ denote the relative efficiencies for the emission of continuum and line radiation, respectively.

For the purposes of synchronizing I(t) with V(t) it was assumed $$K_c = 2.1\ K_l$$

in general agreement with previous results. Then Eq. (1) was evaluated for values of load voltage V(t) input from FIG. 16 and for I(t+r) where I(t) was taken from the raw data and t was an adjustable phase shift. Shown in FIG. 16 is the D(t) computed for the particular value of t giving the current waveform plotted there for comparison. That D(t) represented the best agreement which could be obtained by this procedure. It seems to be reasonably phased with the voltage waveform since appreciable amounts of current are seen to start at the time V(t) begins to break from the form of the open circuit ringing.

The x-ray spectra emitted by the apparatus 110 were sampled with an imaging system formed with a pinhole. The output window 170 was heavily masked with lead collimators, and the detector was similarly masked to admit only the image of the open aperture at the source. In this way the contribution from spurious Compton scattering was minimized. A test for the magnitude of the remaining Compton intensity not originating in the source itself was conducted by blocking only the open aperture at the source. No counts were detected on the scale used for the presentation of the spectra.

Figure 17:
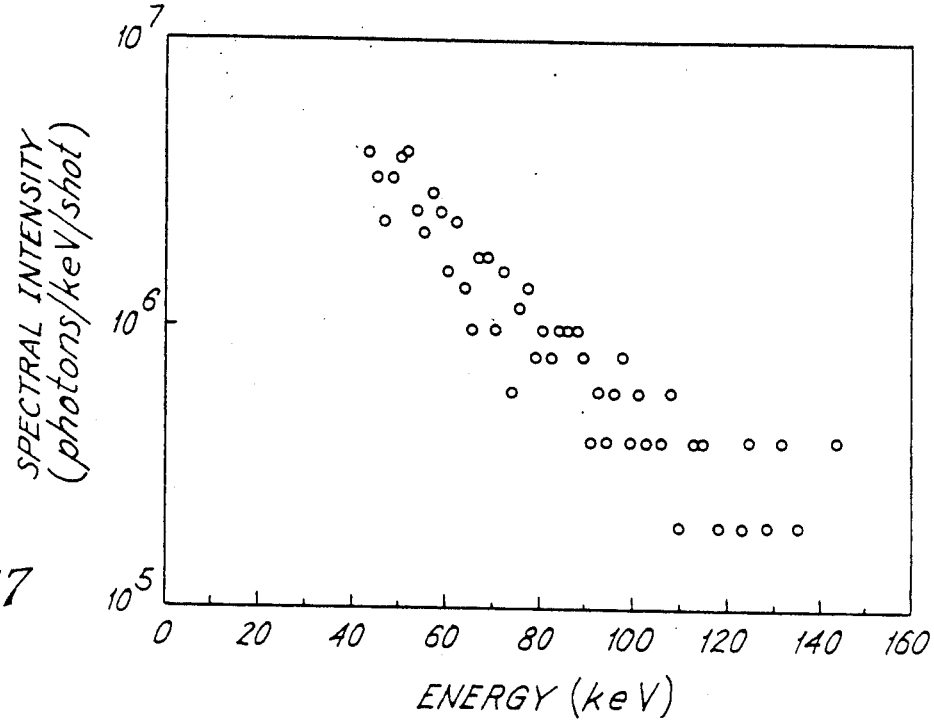

The detector used to observe the image of the source aperture was a NaI(Tl) crystal mounted to a photomultiplier whose output was connected to an ORTEC preamplifier/amplifier combination servicing a multichannel analyzer. ORTEC preamplifier/amplifier combination servicing a multi-channel analyzer. By adjusting the size of the imaging pinhole, the intensity at the scintillator could be reduced to the point at which one photoelectron was counted by the electronics on the average of every three discharges. In this way pulse pileup was avoided. Finally, the spectrum of the counting rate detected at each photon energy was multiplied by the ratio of $2\pi/\Omega$, where $\Omega$ was the measured solid angle of the pinhole. The resulting spectrum is shown in FIG. 17. Data at lower energies than those shown were rendered uncertain by levels of Compton scattering in the detector and so were not plotted in FIG. 17.

Figure 18:
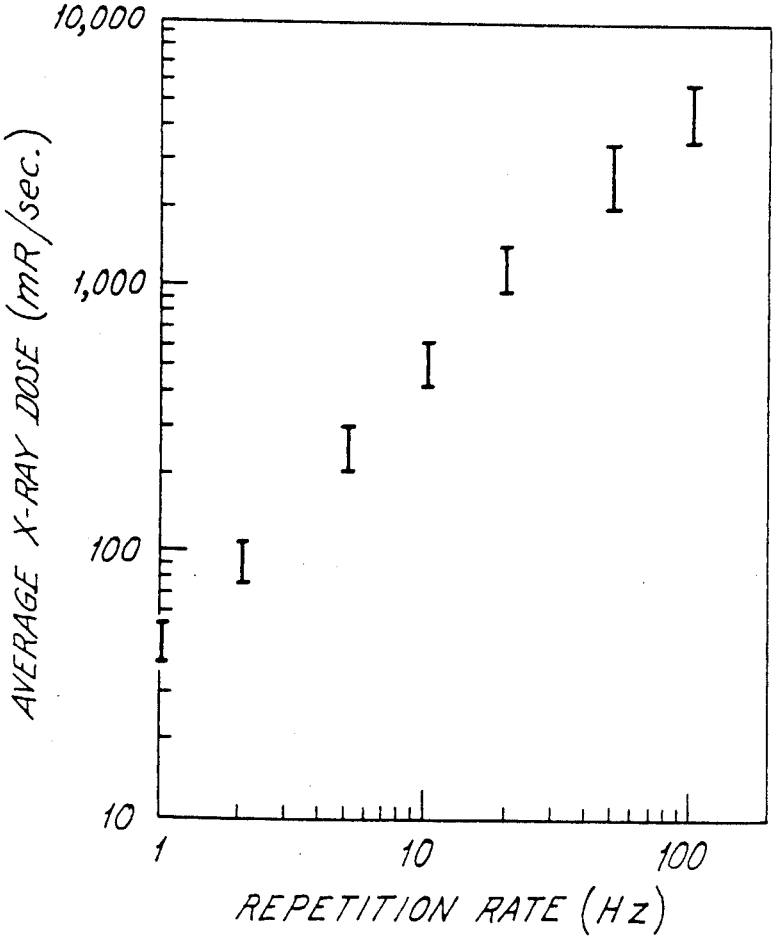

With the apparatus 10, x-ray pulse energies were found to remain largely constant as the pulse repetition rate was varied over the range from 1 to 100 Hz. FIG. 18 shows this to be reflected in the measured values of average dose output in the x-ray pulses of 20 ns duration. emitted from a tungsten anode. Charging voltage for this data was 50 kV.

Apparatus 110 shows that Blumleins 130 can be stacked to obtain voltage gains approaching four times the charging voltages. Operation at high repetition rates (e.g. 100 Hertz) was realized by commutation of a single hydrogen thyratron 120. Average x-ray powers at 100 Hertz resulting from the operation of the apparatus 110 with a charging voltage of 50 kV shows that in less than four minutes, a dose of 1 kR can be delivered to a target sample. This would exceed the dose available in the bremsstrahlung from a shot of a large laser plasma or small e-beam machine. The apparatus 110 makes possible the emission of an average Bremsstrahlung dose of 5.8 R/s from a sequence of 20 ns pulses. When operated t 50 kV charging voltage, spectral measurements show that the output to be a continuum peaking at intensities in excess $2\times10^8$ keV/keV/shot and containing useful intensities of photons having energies of 150 keV.

What is claimed is:

1. An apparatus for producing flash X-rays comprising:

a power source;

communication means coupled to the power source for commuting the current at a high repetition rate;

Blumlein means connected to the commutation means for providing a low impedance switching waveform, the Blumlein means including a plurality of Blumleins chargeable in parallel and connected to the commutation means at one end and configured at the other end to form a series connection; and a X-ray head having a gas sealable chamber having an X-ray emitting aperture, a pair of low impedance spaced-apart electrodes mounted in the chamber, a pair of connectors coupled respectively to said electrodes and to the series connection of the Blumlein means and having a low impedance;

application of commutated current to the Blumlein means effecting a discharge between the electrodes and an X-ray emission through the aperture, the coupling of the Blumlein means, connectors, and electrodes providing a generally matched, low impedance path to said commutated current.

2. The apparatus according to claim 1, said connectors comprising a pair of foils cast integral in the x-ray head between the Blumlein means and electrodes.

3. The apparatus according to claim 1, the x-ray head including a current transformer proximate the electrodes.

4. The apparatus according to claim 3, the commutation means including a thyratron commutable at a repetition rate approaching about 100 Hertz.

5. The apparatus according to claim 4, the commutation means including a pair of spaced apart conductive plates, one of the plates being connected to the thyratron current return and the other plate being connected to the thyratron anode well.

6. The apparatus according to claim 5, the Blumleins each having storage, center, and switching conductors, the switching conductors of each Blumlein being coupled to one of said commutation plates and the center conductors being coupled to the other commutation plate.

7. The apparatus according to claim 3, the low impedance of each Blumlein being less than 100 ohms.

8. The apparatus according to claim 7, the low impedance of each Blumlein being about 1.5 ohms.

9. The apparatus according to claim 3, the low impedance path of said commutated current being less than 100 ohms.

10.

11. A method of producing flash x-rays with an average dose exceeding about 5 roentgen per second comprising the steps of:

supplying a charging current to a thyratron connected to a plurality of Blumleins in parallel;

charging the middle conductor of each Blumlein to a positive voltage;

commutating the input power to each Blumlein at a repetition rate exceeding 10 Hertz;

supplying the power output from the Blumleins in series through a pair of connectors to a pair of spaced-apart electrodes disposed in an evacuated environment; and generating x-ray radiation in the space between the two electrodes having output intensity exceeding $1\times10^5$ photons/keV/shot.

12. The method according to claim 1, wherein the output voltage across said connectors exceeds twice the charging voltage of the Blumleins.

13. The method according to claim 12, wherein the charging voltage of the Blumleins exceeds about 50 KV and the output voltage exceeds 150 KV.

14. The method according to claim 12, wherein the x-ray output peaks at intensities in excess of $2\times10^8$ KeV/shot.

* * * * *

UNITED STATES PATENT AND TRADEMARK OFFICE

CERTIFICATE OF CORRECTION

PATENT NO. : 5,044,004

DATED : August 27, 1991

INVENTOR(S) : Collins et al.

It is certified that error appears in the above-identified patent and that said Letters Patent is hereby corrected as shown below:

Claim 1, column 11, line 16, delete "communication" and substitute therefor --commutation--.

Claim 4, column 12, line 1, delete "3" and substitute therefor --1--.

Claim 7, column 12, line 15, delete "3" and substitute therefor --1--.

Claim 10, column 12, line 22, insert after "10." the phrase --The apparatus according to claim 9, the low impedance path of said commutated current being about 1.5 ohms.--

Claim 12, column 12, line 39, delete "1" and substitute therefor --11--.

Signed and Sealed this

Twenty-third Day of February, 1993

*Attest:*

STEPHEN G. KUNIN

*Attesting Officer*

*Acting Commissioner of Patents and Trademarks*